United States Patent [19]

Suda et al.

[11] Patent Number: 4,769,315

[45] Date of Patent: Sep. 6, 1988

[54] SILVER HALIDE GRAIN AND LIGHT-SENSITIVE PHOTOGRAPHIC MATERIAL CONTAINING SAID SILVER HALIDE GRAIN

[75] Inventors: Yoshihiko Suda; Syoji Matsuzaka; Yasuo Tosaka; Yukio Ohya, all of Hino, Japan

[73] Assignee: Konishiroku Photo Industry Co., Ltd., Tokyo, Japan

[21] Appl. No.: 7,367

[22] Filed: Jan. 27, 1987

[30] Foreign Application Priority Data

Feb. 3, 1986 [JP] Japan ..... 61-21850

[51] Int. Cl.[4] ..... G03C 1/46; G03C 1/02

[52] U.S. Cl. ..... 430/567; 430/506; 430/569

[58] Field of Search ..... 430/567, 569, 506

[56] References Cited

U.S. PATENT DOCUMENTS

| | | | |
|---|---|---|---|
| 3,817,756 | 6/1974 | Claes et al. | 430/567 |
| 4,643,966 | 2/1987 | Maskasky | 430/567 |
| 4,683,192 | 7/1987 | Nishiyama | 430/567 |

FOREIGN PATENT DOCUMENTS 171238 12/1986 European Pat. Off. .

OTHER PUBLICATIONS

J. E. Maskasky "The Seven Different Kinds of Crystal Forms of Photographic Silver Halides", Journal of Imaging Science, vol. 30, No. 6, Nov./Dec. 1986 pp. 247–254.

*Primary Examiner*—Mukund J. Shah

*Attorney, Agent, or Firm*—Frishauf, Holtz, Goodman & Woodward

[57] ABSTRACT

Disclosed are a silver halide grain comprising 8 or 12 concavities on the surface, and a photographical light-sensitive material containing a silver halide grain having 8 to 12 concavities on the surface.

According to the present invention, there can be obtained silver halide grains having still higher sensitivity and also improved in the relationship of sensitivity-fog as compared with those of the prior art, and also a light-sensitive silver halide material by use of an emulsion containing said grains.

19 Claims, 3 Drawing Sheets

SILVER HALIDE GRAIN AND LIGHT-SENSITIVE PHOTOGRAPHIC MATERIAL CONTAINING SAID SILVER HALIDE GRAIN

BACKGROUND OF THE INVENTION

This invention relates to a light-sensitive silver halide grain suitable for higher sensitization, a method for producing the same and a light-sensitive silver halide photographic material containing the same.

In recent years, extremely high levels of photographic characteristics of silver halide emulsion have been demanded such as high sensitivity, excellent graininess, high sharpness, low fog density, high maximum density, etc. Improvement of these characteristics is attributable to how sensitivity of silver halide grains contained in the emulsion to light is enhanced. That is, if grains having high sensitivity can be obtained, it becomes possible to make finer the silver halide grains for obtaining a light-sensitive material with a desired sensitivity, whereby its image quality, fog, etc., can be improved as is well known in the art. In the prior art, the demand for high sensitization has been primarily directed to light-sensitive material for nega using silver iodotromide emulsion, but recently higher sensitization is also demanded strongly for the purpose of improving efficiency in print working for the light-sensitive material using silver chlorobromide emulsion for color paper, etc., which has been accepted as having relatively low sensitivity. Thus, under the present situation, developments of higher sensitization techniques applicable for silver halide grains having various silver halide compositions have been continued.

Responding to these demands, as a high sensitivity emulsion, an emulsion containing 0 to 15 mol % of iodine in the form of silver iodobromide has been well known. As the methods for preparing these emulsions, there have been heretofore known the methods for controlling pH condition, pAg condition such as the ammonia method, the neutralization method, the acidic method, etc., and the mixing methods such as the single jet method, the double jet method, etc.

In order to accomplish further higher sensitivity, fine graininess, high sharpness, low fog on the basis of these known techniques, more precise technical means have been developed and researches have been made in silver iodobromide emulsion about emulsions in which not only crystal habit, grain size distribution, but also the concentration distribution of iodine within individual silver halide grains are controlled.

The most orthodox method for accomplishing high photographic performances as mentioned above is to enhance quantum efficiency of silver halide grains, and the research speculating on the influence of grain size distribution by calculating theoretically quantum efficiency is reported in, for example, preliminary textbook of Tokyo Symposium concerning progress of photography in 1980, "Interactions between Light and Materials for Photographic Applications", page 91. According to this research, it is suggested effective for improvement of quantum efficiency to use a mono-dispersed emulsion having a narrowed grain size distribution. Further, in the step of chemical sensitization practiced after formation of grains, a mono-dispersed emulsion may be considered advantageous for accomplishing high sensitivity with good efficiency while maintaining low fog.

For producing industrially a mono-dispersed emulsion, control of the speed for feeding silver ions and halogen ions in an amount theoretically determined to the reaction system and sufficient stirring are requlred under strict control of pAg and pH, as described in Japanese Unexamined patent Publication No. 48521/1980. The silver halide grains produced under such conditions comprise the so called normal crystals having a shape of either cube, octahedron or tetradecahedron, which have been known to be highly sensitized.

Also, as the silver halide grains which can give further higher sensitivity, Japanese Unexamined patent Publication No. 35440/1986 and No. 83531/1986 disclose silver iodobromide grains having the (110) face and semi-(110) face, respectively. Also, in Japanese Patent Publication No. 42737/1980, there is disclosed a photographic emulsion containing rhombododecahedral silver chlorobromide grains having the (110) face as having smaller fog. Further, Japanese Patent Applications No. 20593/1986 and No. 35585/1986 disclose photographic emulsions containing silver bromide, silver iodobromide, silver chlorobromide, silver chloroiodobromide having the (nn1) face, and it is shown that the (nn1) face has the same meaning as the above mentioned semi-(110) face.

The silver halide grains having the (110) face and the (nnl) face as described above can afford considerable improvements in aspects of sensitivity or fog, but they cannot be said to be satisfactory yet as seen from the levels of performances demanded presently for light-sensitive materials, and under the present situation silver halide grains with further higher sensitivity and lower fog have been required.

SUMMARY OF THE INVENTION

An object of the present invention is to provide silver halide grains having still higher sensitivity and also improved in the relationship of sensitivity-fog as compared with those of the prior art, and also a light-sensitive silver halide material by use of an emulsion containing said grains.

The present inventors have made various investigations and consequently found that the above object can be accomplished by silver halide grains comprising 8 or 12 concavities on the surface and a light-sensitive material having at least one light-sensitive layer by use of a photographic emulsion containing said grains.

Figure 1:
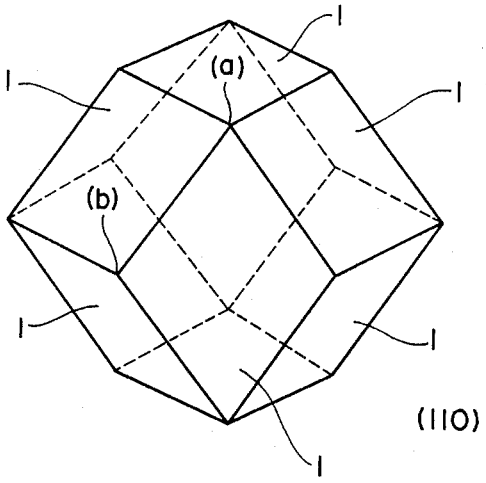
FIGS. 1 to 4 are ones to illustrate formation process of the silver halide grains according to the present invention.

In the above FIGS., 1, 2, 3, 4 and 5 denote (110) face, (111) face, (100) face, (nn1) face and a central ridge line of (110) face, respectively.

DETAILED DESCRIPTION OF THE PREFERRED EMBODIMENTS

The silver halide grain of the present invention has 8 or 12 concavities on its surface as mentioned above, and the composition of the silver halide constituting the grain is not particularly limited, but silver chloride, silver bromide, silver chlorobromide, silver iodobromide, silver chloroiodobromide, etc., may be included as preferable composition. For the silver halide as mentioned above containing silver iodide, those containing 40 mol % or less of silver iodide are preferred.

The silver halide grain of the present invention may be one having 8 or 12 concavities on the surface, and Its preparation method is not particularly limited, but it is preferable to use the method in which the grain comprising a normal crystal of the silver halide of the above composition is treated for a certain period of time under pAg which is higher than the average pAg of the mother liquor during formation of said grain.

The crystal habit of the grain to be treated is not particularly limited, but it is preferable to use a grain having (110) and/or (nn1) face.

The above grain having (110) face or (nn1) face can be prepared by the method as disclosed in, for example, Japanese patent Publication No. 42737/1980, West Germany patent No. 2932185, Japanese Unexamined patent Publication No. 222842/1985, Japanese patent application No. 158111/1984 or Japanese patent application No. 202765/1984. The crystal habit of the grain of which outer surfaces are all constituted of (110) faces is rhombododecahedron (FIG. 1), but the silver halide grain to be applied with the deformation treatment in the present invention is not limited to this, but it may have outer surfaces having (100) face and/or (111) face combined in various forms which will appear in conventional silver halide grains, and therefore a diversity of forms may be included. As examples, those having 6 (six) (100) faces, 8 (eight) (111) faces, 12 (twelve) (110) faces (FIG. 2) as described in the above Japanese patent application No. 158111/1984 may be included.

The silver halide grain has different physical properties depending on which one of the crystal faces (100), (110) or (111) appears on the surface of the silver halide grain, and when this is placed in an atmosphere with a relatively high solubility of silver halide, the respective crystal faces will be dissolved at different dissolving rates. More specifically, under the condition with greater dissolving rate of the (110) face as compared with other faces, the portion of the (110) face of the grain surface is dissolved to form 12 concavities on the grain surface. On the other hand, under the condition of greater dissolving rate of the (111) face than the dissolving rate of other faces, the portion of the (111) face of the grain surface is dissolved to form 8 concavities. The silver ions and the halide ions formed by dissolving at this time will be recrystallized on other crystal faces with smaller dissolving rate, whereby fine silver halide crystal having distinct concavities and convexities can be obtained.

Figure 2:
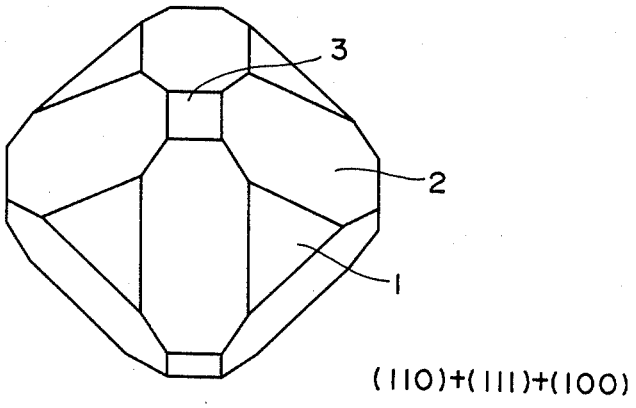

Also, in the rhombododecahedron (FIG. 1) of which outer surfaces are all constituted of (110) faces, similar deformation of the grain is possible and 12 concavities are formed under the condition with greater dissolving rate of the (110) face. On the other hand, under other conditions, the apex (b) in FIG. 1 is dissolved to form 8 concavities. Even in the fine silver halide crystal which appears to be constituted of rhombododecahedron, namely only of (110) faces in the electromicroscope photograph, (100) face or (111) face may be considered to exist microscopically near its apex. That is, the apex (a) in FIG. 1 is oriented toward the direction of [100] and in the vicinity thereof (100) face would exist, while the apex (b) is oriented toward the direction of [111], and in the vicinity thereof (111) face would exist. Accordingly, when the grain is exposed to an atmosphere where the dissolving rate of the (111) face becomes greater, dissolution will occur from near the apex (b), whereby the grain having 8 concavities is considered to be formed.

Figure 3:
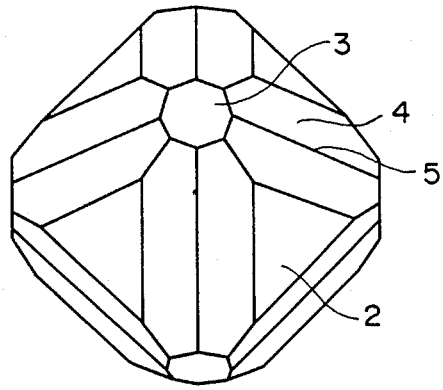
Figure 4:
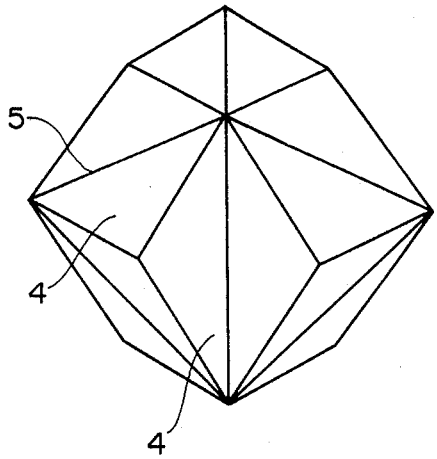

Also, in the grain having the (nn1) face in place of the (110) face as shown in FIG. 3 and FIG. 4, under the condition with greater dissolving rate of the (nn1) face as compared with other faces, 24 concavities should be theoretically formed on the grain surface. However, when the (nn1) face is dissolved, in most cases, the dissolving speed in the vicinity of the ridge line 5 (FIG. 3), (FIG. 4) becomes the greatest and consequently, the adjacent concavities are linked to form substantially 12 concavities.

When the grain is placed under the condition with equal extent of dissolving rate of the (110) face and the dissolving rate of the (111) face, or the condition is varied in the course of the deformation process of the grain, an intermediate grain between the grain having 8 concavities and the grain having 12 concavities will be formed, and such a grain is also included in the present invention.

Also, it is possible to prepare the silver halide grain of the present invention from the grain having microscopically no (110) face or (nn1) face, namely the grain of which outer surfaces are constituted only of (111) face and/or (100) face. That is, when the grain as mentioned above is placed under the condition where the (111) face is preferentially dissolved, partial dissolution occurs to form the grain having 8 concavities. Also, in the grain having (111) face and/or (100) face, the (110) face or the (nn1) face may be considered to exist microscopically on its side, and therefore under the condition where the (110) face or the (nn1) face is preferentially dissolved, the silver halide grain having 12 concavities of the present invention can be obtained.

As described above, the silver halide grain of the present invention can be obtained by deformation treatment of the silver halide grain having various crystal habits under high solubility conditions, but the grain before deformation should preferably have the (110) and/or (nn1) face as mentioned above, and it is most preferred to use the grain having the (nn1) face with respect to rapid deformation speed.

The silver halide grain having 8 or 12 concavities obtained as described above has a great difference in physical and chemical properties between the concavities and the convexities, and therefore it may be considered that sensitizing means such as chemical sensitization, reduction sensitization, optical sensitization, etc., subsequently effected can be applied more effectively to give a silver halide grain with extremely high sensitivity.

The timing when the above deformation treatment is performed is not particularly limited, but it may be practiced at any time during the preparation steps of silver halide emulsion, even in two or more steps, but it is preferable to be practiced at a period before initiation of chemical aging including the step of forming silver halide crystals, most preferably on completion of formation of crystals, namely immediately before initiation of the desalting step.

The silver halide grains according to the present invention can be formed by use of various known mixing methods such as the single jet method, the double jet method, etc., under the various known conditions such as the ammonia method, the neutralization method, the acidic method, etc., but it is preferable to use the method in which the grains are formed by the double jet method according to the ammonia method recipe by use of an ammoniacal silver nitrate as the silver ion solution. In this case, the concentration of free ammonia should be preferably 0.1N or higher, more preferably 0.2N or higher. The pH should be preferably 6 or higher, more preferably 7 or higher. The pAg may be 6 or higher, preferably 7 or higher, more preferably 8 or higher. The size distribution of the grains may be poly-dispersed, but it is preferable to use mono-dispersed grains.

For formation of 8 or 12 concavities on the surface of the silver halide grain obtained as described above, it is preferable to use the method in which treatment is conducted under pAg which is higher than the average pAg of the mother liquor during formation of said grain. Practically, in the case of silver bromide, silver iodobromide, silver chloroiodobromide, preferable pAg value is 9 or higher, more preferably pAg is adjusted to 10 or higher. On the other hand, in the case of silver chlorobromide, preferable pAg is 7.0 or higher, more preferably 8 or higher.

For the light-sensitive material of the present invention, the silver halide grains of the present invention obtained as described above having an average grain size of 0.1 to 3.0 μm may be preferably used.

One of the most preferred embodiments of the present invention is to mix the silver halide grain having (110) face and/or the (nn1) face with an ammoniacal silver salt solution and a halide solution according to the double jet method and, after completion of mixing, leave the mixture at enhanced pAg to stand at a constant temperature for a certain period of time before entering the desalting step. The pH during this period may be within the range as mentioned above. The period of treatment may differ depending on pH, pAg and temperature, but it is shorter as the silver halide solubility is higher. To mention an example, in the case of silver bromide of which outer surfaces are all constituted of (nn1) faces, it takes about 15 minutes under the conditions of 50° C., pH 7.5 and pAg 9.8; 5 minutes at pAg 10.4; but desired grains can be obtained within 1 minute at pAg 10.8.

The silver halide grain of the present invention can be applied with reduction sensitization at any desired time during the preparation steps.

Reduction sensitization may be performed by stirring the emulsion under low pAg condition; namely by silver aging, or alternatively by use of a suitable reducing agent such as stannous chloride, dimethylamine borane, hydrazine, thiourea dioxide, etc.

The silver halide grain of the present invention may be also applied with doping with various metal salts or metal complexes during formation by precipitation of silver halide, during growth of grains or after completion of growth. For example, metal salts or complex salts of gold, platinum, palladium, iridium, rhodium, bismuth, cadmium, copper, etc., or combinations thereof may be applicable.

The excessive halide compounds, or salts or compounds such as nitrates, salts of ammonia, etc., which are by-produced or bacame unnecessary, formed during preparation of the silver halide grain of the present invention may be removed from the dispersing medium of said grain. As the method for removal, it is possible to use the Noodel water washing method, the dialyzing method or the coagulation precipitation method, etc., conventionally used in general emulsions.

Also, for the silver halide grain of the present invention, various chemical sensitization methods applied to general emulsions can be applied. That is, chemical sensitization can be effected with the use of active gelatin, noble metal sensitizers such as water-soluble gold salts, water-soluble platinum salts, water-soluble palladium salts, water-soluble rhodium salts, water-soluble iridium salts, etc.; sulfur sensitizers; selenium sensitizers; chemical sensitizers such as reduction sensitizers as mentioned above, etc., either singly or in combination.

Further, the silver halide grain can be optically sensitized to a desired wavelength region. The optical sensitization method for the emulsion of the present invention is not particularly limited, but optical sensitization can be effected by using optical sensitizers, including cyanine dyes or melocyanine dyes such as zeromethine dye, monomethine dye, dimethine dye, trimethine dye, etc., either singly or in combination (for example, ultracolor sensitization). These techniques are also described in U.S. Pat. Nos. 2,688,545, 2,912,329, 3,397,060, 3,615,635 and 3,628,964; U.K. patent Nos. 1,195,302, 1,242,588 and 1,293,862; West Germany patent Nos. (OLS) 2 030 326 and 2 121 780; Japanese patent Publications No. 4936/1968 and No. 14030/1969, etc. It can be selected as desired depending on the wavelength region to be sensitized, sensitivity, the purpose of the light-sensitive material, the use, etc.

The silver halide grain of the present invention may be provided for use as such, or alternatively two or more kinds of grains with different average particle sizes may be blended at any desired time after formation of the grains to obtain a desired gradation before use. Otherwise, it can be also used as a mixture with silver halide grains other than that of the present invention.

As the binder for the silver halide grain according to the present invention or the dispersing medium to be used for preparation of said grain, hydrophilic colloids conventionally used for silver halide emulsion can be used. As the hydrophilic colloid, not only gelatin (which may be either lime-treated or acid-treated), but also gelatin derivatives, polymeric grafts of gelatin, synthetic hydrophilic polymeric materials, natural hydrophilic polymeric materials other than gelatin can be employed. The emulsion containing the silver halide grain according to the present invention can contain various additives conventionally used depending on the purpose. These additives may include, for example, stabilizers or antifoggants such as azaindenes, triazoles, tetrazoles, imidazolium salts, tetrazolium salts, polyhydroxy compounds, etc.; film hardeners such as aldehyde type, aziridine type, inoxazole type, vinylsulfone type, acryloyl type, carbodiimide type, maleimide type, methane sulfonic acid ester type, triazine type, etc.; developing promotors such as benzyl alcohol, polyoxyethylene type compounds; image stabilizers such as chroman type, chramane type, bisphenol type, phosphite ester type; lubricants such as wax, glyceride of higher fatty acids, higher alcohol esters of higher fatty acids, etc. Also, various anionic, cationic, nonionic or amphoteric surfactants may be available as the coating aid, the agent for improving penetrability of processing liquors, etc., the defoaming agent or the material for controlling various physical properties of the light-sensitive material. As the antistatic agent, diacetyl cellulose, styrene perfluoroalkylsodium maleate copolymer, alkali salt of the reaction product of styrene-maleic anhydride copolymer and p-aminobenzene sulfonic acid, etc., may be effectively used. As the matting agent, there may be employed polymethyl methacrylate, polystyrene and alkali-soluble polymer, etc. Further, it is possible to use colloidal silicon oxide. Also, as the latex to be added for improvement of film properties, there may be employed copolymers of acrylic acid ester, vinyl ester, etc., with other monomers having ethylene groups. Examples of the gelatin plasticizer may include glycerine, glycol type compounds, and examples of the thickener may include styrene-sodium maleate copolymer, alkyl vinyl ether-maleic acid copolymer, etc.

The silver halide grain according to the present invention can be applied effectively for light-sensitive photographic materials for various uses such as for black-and-white in general, for X-ray, for color, for IR, for micro, for silver dye bleaching method, for reversal, for diffusion transfer method, etc.

The emulsion having the silver halide grain of the present invention can have abundunt latitude by mixing at least two kinds of emulsions with different average grain sizes or different sensitivities, or by coating plural layers. For applying the silver halide grain according to the present invention to light-sensitive photographic material for color, the method and the materials used for the light-sensitive material for color may be employed such as incorporating cyan, magenta and yellow couplers in combination into the emulsion containing the silver halide grain according to the present invention controlled to red-sensitive, green-sensitive and blue-sensitive. As the yellow coupler, open chain ketomethylene type couplers may be employed. Among them, benzoylacetoanilide type and pivaloyl-acetoanilide type compounds are useful.

As the magenta coupler, pyrazolone type compounds, indazolone type compounds, cyanoacetyl compounds can be employed, while as the cyan coupler, phenol type compounds and naphthol type compounds may be employed.

In the light-sensitive silver halide photographic material of the present invention, each of the red-sensitive emulsion layer, green-sensitive emulsion layer and blue-sensitive emulsion layer may consist of two or more layers. For example, in the color nega light-sensitive photographic material, usually two layers or three layers may be preferably used. Said each emulsion layer may be provided by coating at any position which can be determined as desired depending on the purpose of use. When a plural number of the same color-sensitive layers are used, they can be provided by coating separately from each other.

The emulsion layer containing the silver halide grain according to the present invention can be applied to any desired layer of these light-sensitive layers. When each color-sensitive layer consists of two or more layers with different sensitivities, the effect of the present invention is greater when applied to the layer with higher sensitivity than when applied to the layer with lower sensitivity.

As the support of the light-sensitive photographic material, for example, there may be suitably selected depending on the purpose of use of the respective light-sensitive photographic material from baryta paper, polyethylene coated paper, polypropylene synthetic paper, glass, cellulose acetate, cellulose nitrate, polyvinylacetal, polypropylene, polyester film such as polyethylene terephthalate, etc., polystyrene and other conventionally used materials.

These supports may be applied with subbing working if necessary.

The light-sensitive photographic material having the silver halide grain according to the present invention can be subjected after exposure to developing processing according to a conventionally used known method.

The black-and-white developing solution is an alkali solution containing a developing agent such as hydroxybenzenes, aminophenols, aminobenzenes, etc., and otherwise can also contain sulfites, carbonates, bicarbonates, bromides and iodides, etc., of alkali metals. On the other hand, when said light-sensitive photographic material is for color, it can be color formed according to the color forming method conventionally used. According to the reversal method, development is first effected with a black and white nega developing solution and then white light exposure is given or treatment in a bath containing a fogging agent is effected, and further color development is carried out with an alkali developing solution containing a color developing agent. The processing method is not particularly limited, but all processing methods can be applied. For example, a typical system comprises performing color developing, bleach-fixing processing, and further water washing, stabilizing processing, if necessary. Alternatively, another system comprises performing color developing, then bleaching and fixing separately, and further water washing and stabilizing processing, if necessary.

The present invention is described in detail below by referring to Examples, by which the present invention is not limited at all.

In the following Examples, the fluctuation coefficient used for indicating the grain size distribution state of the grains is a coefficient determined by the formula shown below, and the grain size distribution is narrower as this value is smaller, indicating higher mono-dispersibility. The grain size is defined as the length of one size of the cube with the same volume.

$$\text{Fluctuation coefficient (\%)} = \frac{\text{Standard deviation of grain size distribution}}{\text{Average grain size}} \times 100$$

EXAMPLE 1

By use of the five kinds of solutions shwon below, silver iodobromide grains (EM-1 to 3) containing 6 mol % of silver iodide were prepared. The seed emulsion was a mono-dispersed silver iodobromide emulsion containing 6 mol % of silver iodide, said emulsion grains having an average grain size of 0.8 μm and a fluctuation coefficient of grain size distribution of 10%.

| | |
|---|---|
| (Solution A-1) | |
| Ossein gelatin | 22.5 g |
| Distilled water | 6850 ml |
| Polyisopropylene-polyethyleneoxy-disuccinic acid ester sodium salt 10% Ethanolic aqueous solution | 20 ml |
| 4-Hydroxy-6-methyl-1,3,3a,7-tetra-azaindene | amount as shown in Table 1 |
| 28% Aqueous ammonia solution | 469 ml |
| 56% Aqueous acetic acid solution | 258 ml |
| Seed emulsion | amount corresponding to 0.8828 mol |
| (Solution B-1) | |
| Ossein gelatin | 24 g |
| KBr | 938 g |
| KI | 83.6 g |
| 4-Hydroxy-6-methyl-1,3,3a,7-tetra-azaindene | amount as shown in Table 1 |
| Distilled water | 1978 ml |

-continued

| | |
|---|---|
| (Solution E-1) | |
| $AgNO_3$ | 1109 g |
| 28% Aqueous ammonia solution | 904 ml |
| Made up to 1866 ml with addition of distilled water. | |
| (Solution F-1) | |
| 50% aqueous KBr solution | amount necessary for pAg adjustment |
| (Solution G-1) | |
| 56% Aqueous acetic acid solution | amount necessary for pH adjustment |

At 50° C., by means of a mixing stirrer as disclosed in Japanese Unexamined Patent Publicaitons No. 92523/1982 and No. 92524/1982, the solution A-1 was mixed with a solution E-1 and the solution B-1 according to the simultaneous mixing method. The pAg, pH and the addition rate of the solution E-1, and B-1 during mixing were controlled as shown in Table-2 for EM-1, 2 and as shown in Table 3 for EM-3. The controlling of the pAg and pH were carried out by using a flow rate variable roller tube pump while varying the flow rates of the solution F-1 and the solution G-1.

TABLE 1

| Emulsion | (Solution A-1) amount added | (Solution B-1) amount added |
|---|---|---|
| EM 1 | 554 mg | 333 mg |
| EM 2 | 554 mg | 333 mg |
| EM 3 | 646 mg | 2560 mg |

One minute after completion of the addition of the solution E-1, pAg of EM-1 was adjusted to 10.5 with the solution F-1 and after conducting the deformation treatment of the grains according to the present invention by stirring for 10 minutes, the pH was adjusted to 6.0 with the solution G-1.

The pH of EM-2 was adjusted to 6.0 with the solution G-1 one minute after completion of the addition of E-1.

TABLE 2

| Time (min) | Addition rate of solution (ml/min.) E-1 | B-1 | pAg | pH |
|---|---|---|---|---|
| 0.00 | 6.35 | 6.32 | 8.60 | 9.00 |
| 7.10 | 7.08 | 7.04 | 8.60 | 9.00 |
| 14.20 | 7.80 | 7.76 | 8.60 | 9.00 |
| 21.30 | 8.55 | 8.51 | 8.60 | 9.00 |
| 28.40 | 9.31 | 9.26 | 8.60 | 9.00 |
| 35.50 | 10.08 | 10.03 | 8.60 | 9.00 |
| 42.60 | 10.84 | 10.79 | 8.60 | 9.00 |
| 49.80 | 11.56 | 11.50 | 8.60 | 9.00 |
| 57.20 | 17.90 | 17.81 | 8.60 | 9.00 |
| 60.60 | 34.10 | 33.93 | 8.60 | 9.00 |
| 64.30 | 51.72 | 51.46 | 8.60 | 8.90 |
| 67.00 | 53.03 | 52.76 | 8.60 | 8.70 |
| 69.70 | 54.35 | 54.08 | 8.60 | 8.48 |
| 72.30 | 55.67 | 55.39 | 8.60 | 8.27 |
| 75.40 | 48.04 | 47.80 | 8.60 | 8.05 |
| 78.50 | 40.40 | 40.20 | 8.60 | 7.84 |
| 82.90 | 33.85 | 33.68 | 8.60 | 7.61 |
| 87.20 | 27.30 | 27.16 | 8.60 | 7.50 |

TABLE 3

| Time (min) | Addition rate of solution (ml/min.) E-1 | B-1 | pAg | pH |
|---|---|---|---|---|
| 0.00 | 7.07 | 7.03 | 8.70 | 9.00 |
| 18.00 | 8.89 | 8.85 | 8.70 | 9.00 |

TABLE 3-continued

| Time (min) | Addition rate of solution (ml/min.) E-1 | B-1 | pAg | pH |
|---|---|---|---|---|
| 27.00 | 9.75 | 9.70 | 8.70 | 9.00 |
| 36.00 | 10.55 | 10.49 | 8.70 | 9.00 |
| 45.00 | 11.29 | 11.23 | 8.70 | 9.00 |
| 46.60 | 11.51 | 11.45 | 8.70 | 9.00 |
| 54.80 | 16.44 | 18.21 | 8.93 | 8.86 |
| 63.05 | 21.38 | 24.85 | 9.30 | 8.66 |
| 72.05 | 32.84 | 61.18 | 9.96 | 8.31 |
| 75.50 | 26.31 | 54.97 | 10.19 | 8.21 |
| 82.50 | 24.12 | 24.00 | 10.20 | 8.04 |
| 90.06 | 21.89 | 21.78 | 10.20 | 7.86 |
| 99.08 | 20.13 | 20.03 | 10.20 | 7.66 |
| 108.00 | 19.25 | 19.16 | 10.20 | 7.50 |

The pAg of EM-3 was adjusted to 10.4 with the solution F-1 two minutes after completion of the addition of E-1, and further two minutes later, the pH was adjusted to 6.0 with the solution G-1.

Next, the desalting and washing was carried out in a conventional manner for each of the three kinds of emulsions, and the mixture was dispersed in an aqueous solution containing 127 g of ossein gelatin and the total amount was adjusted to 3000 ml with distilled water, followed further by adjustment to pAg 8.5 and pH 5.8 at 40° C. with the solutions F-1 and G-1.

Figure 5:
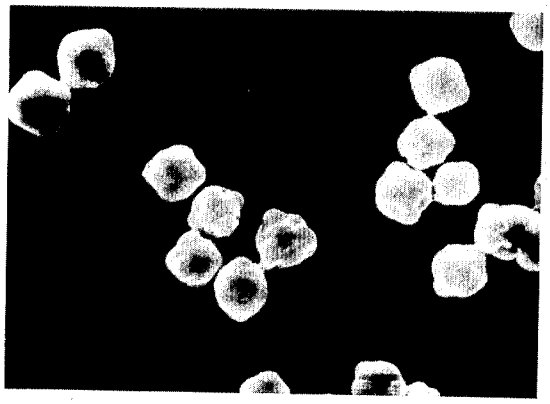
FIG. 5 is a microscopic photograph of the silver halide grains of the present invention and FIGS. 6 and 7 are microscopic photographs of comparative silver halide grains.
Figure 6:
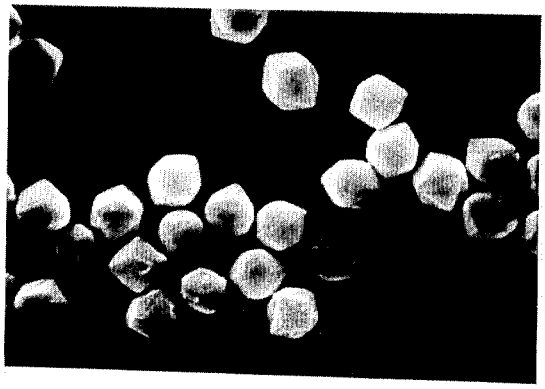
Figure 7:
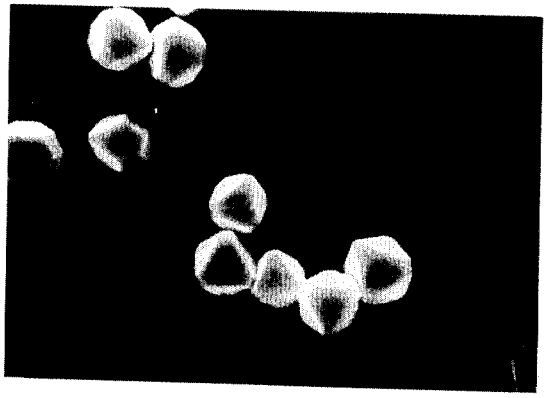

The silver halide grains in the samples EM-1 to 3 obtained were found to have the shapes as shown in the electron microscope photographs FIG. 5 to FIG. 7. As can be seen in the Figures, EM-1 is the grain according to the present invention having 12 concavities on the surface, an average grain size of 1.60 μm and a fluctuation coefficient of grain size of 12%. EM-2 is a monodispersed emulsion comprising 24-hedral grains having (nn1) face corresponding to the grains before the deformation treatment of EM-1, having an average grain size of 1.60 μm and a fluctuation coefficient of 11%. EM-3 is a octahedral grain, having an average grain size of 1.60 μm and a fluctuation coefficient of 11%. By use of the above emulsions EM-1-3, single layer coated samples, and multi-layer color nega light-sensitive materials having sensitivities of blue-sensitive, green-sensitive and red-sensitive layers were prepared, and their performances were compared.

[Single layer coated sample]

After the optimum gold-sulfur sensitization was applied to EM-1-3 with addition of appropriate amounts of sodium thiosulfate and sodium chloroaurate respectively, 4-hydroxy-6-methyl-1,3,3*a*,7-tetraazaindene and 1-phenyl-5-mercaptotetrazol were added, followed further by addition of bis(vinylsulfonylmethyl) ether and saponin before coating. The mixture was applied on a transparent support to a silver content of 3.0 g/m$^2$ and a gelatin content of 2.0 g/m$^2$ to prepare samples No. 1-No. 3. These samples were subjected to white light exposure through an optical wedge by use of KS-1 model sensitometer (produced by Konishiroku Photo Industry), and processed by a developing solution having the following composition at 20° C. for about 10 minutes.

| [Developing solution composition] | |
|---|---|
| Metol | 6 g |
| Anhydrous sodium sulfite | 50 g |
| Hydroquinone | 6 g |

-continued

| [Developing solution composition] | |
|---|---|
| Sodium carbonate | 29.5 g |
| Potassium bromide | 1.0 g |
| (made up to one liter with addition of water) | |

The developed samples were subjected to optical density measurement with white light in a conventional manner to determine fog and sensitivity.

Fog . . . Value obtained by detracting the support density, and the mask density (in the case of the light-sensitive material by use of a colored coupler) from minimum optical density of the so called characteristic curve obtained by sensitometry. Fog is higher as this value is greater, and is not desirable.

Sensitivity . . . Reciprocal value of the dose (genuine value) which gives the optical density of the minimum optical density +0.1 on the characteristic curve (in the Table showing the results of Examples, represented in terms of relative value with the sensitivity of the control emulsion as being 100). Sensitivity is higher as this value is greater, and preferable.

The results obtained are shown in Table 4.

TABLE 4

| Sample | Emulsion used | Fog | Relative sensitivity |
|---|---|---|---|
| No. 1 (Invention) | EM-1 | 0.11 | 139 |
| No. 2 (Control) | EM-2 | 0.11 | 125 |
| No. 3 (Control) | EM-3 | 0.13 | 100 |

As is apparent from the Table, the sample No. 1 by use of the silver halide grains according to the present invention is more excellent in sensitivity-fog characteristics than control samples No. 2 and No. 3.

[Multi-layer color nega light-sensitive material (called overlaid sample)]

Chemical sensitization was applied in a conventional manner to the emulsions EM-1 to EM-3 prepared as described above, and color light-sensitive materials having the three kinds of light-sensitive layers of blue-sensitive, green-sensitive and red-sensitive layers were prepared. The emulsions of EM-1 to EM-3 applied with chemical sensitization were used in the green-sensitive high sensitive layer (GH) or the blue-sensitive high sensitivity layer (GB) as shown in Table-6. In other light-sensitive layers, entirely the common emulsions were used for respective samples.

Samples were prepared by providing the respective layers shown below by coating on a transparent support (Base) comprising cellulose triacetate film applied with subbing working and having a halation preventive layer (containing 0.40 g of black colloidal silver and 3.0 g of gelatin). In all the Examples shown below, the amount added in the light-sensitive material shows the amount per 1 $m^2$, and the silver halide emulsion and colloidal silver were shown as calculated on silver.

Low sensitivity red-sensitive layer (RL) . . . A low-sensitivity red-sensitive emulsion layer containing 1.4 g of a low-sensitivity red-sensitive silver iodobromide (containing 7 mol % of silver iodide) which has been color sensitized to red-sensitive, 1.2 g of gelatin and 0.65 g of tricresil phosphate (TCP) containing dissolved therein 0.8 g of 1-hydroxy-4-(β-methoxyethylaminocarbonylmethoxy)-N-[δ-(2,4-di-t-amylphenoxy)butyl]-2-naphthoamide [hereinafter called C-1], 0.075 g of 1-hydroxy-4-[4-(1-hydroxy-δ-6-acetamide-3,6-disulfo-2δ-(2,4-di-t-amylphenoxy)butyl-2-naphthoamide disodium [hereinafter called colored cyan coupler (CC-1)] and 0.015 g of 1-hydroxy-2-[δ-(2,4-di-t-amylphenoxy)n-butyl]-naphthoamide, 0.07 g of 4-octadecylsuccinimide-2-(1-phenyl-5-tetrazolylthio)-1-indanone [hereinafter called DIR compound (D-1)].

RH . . . A high-sensitivity red-sensitive emulsion layer containing 1.3 g of a high-sensitivity red-sensitive silver iodobromide emulsion, 1.2 g of gelatin and 0.23 g of TCP containing 0.21 g of the cyan coupler (C-1) and 0.02 g of the colored cyan coupler (CC-1) dissolved therein.

I . . . An intermediate layer containing 0.04 g of n-dibutyl phthalate [hereinafter called DBP] having 0.07 g of 2,5-di-t-octylhydroquinone [hereinafter called anti-staining agent (HQ-1)] dissolved therein and 0.8 g of gelatin.

GL . . . A low-sensitivity green-sensitive emulsion layer containing 0.80 g of a low-sensitivity silver iodobromide (containing 6 mol % of silver iodide) which has been color sensitized to green-sensitive, 2.2 g of gelatin and 0.95 g of TCP containing 0.8 g of 1-(2,4,6-trichlorophenyl)-3-[3-(2,4-di-t-amylphenoxyacetamide)benzamide]-5-pyrazolone (hereinafter called magenta coupler (M-1)), 0.15 g of 1-(2,4,6-trichlorophenyl)-4-(1-naphthylazo)-3-( 2-chloro-5-octadecenylsuccinimideanilino)-5-pyrazolone [hereinafter called colored magenta coupler (CM-1)] and 0.016 g of the DIR compound (D-1) dissolved therein.

GH . . . A high-sensitivity green-sensitive emulsion layer containing 1.8 g of a high-sensitivity green-sensitive silver iodobromide emulsion which has been color sensitized to green-sensitive, 1.9 g of gelatin and 0.25 g of TCP containing 0.20 g of magenta coupler (M-1) and 0.049 g of the colored magenta coupler (CM-1) dissolved therein.

Y . . . A yellow filter layer containing 0.15 g of yellow colloidal silver, 0.11 g of DBP having 0.2 g of the anti-staining agent (HQ-1) dissolved therein and 1.5 g of gelatin.

BL . . . A low-sensitivity blue-sensitive emulsion layer containing 0.2 g of a low-sensitivity silver iodobromide emulsion (containing 4 mol % of silver iodide) which has been color sensitized to blue-sensitive, 1.9 g of gelatin and 0.6 g of TCP having 1.5 g of α-pivaroyl-α-(1-benzyl-2-phenyl-3,5-dioxoimidazolidin-4-yl)-2'-chloro-5'-[α-dodecyloxy-carbonyl)ethoxycarbonyl]acetoanilide [hereinafter called Y-1] dissolved therein.

BH . . . A high-sensitivity blue-sensitive emulsion layer containing 1.0 g of a high-sensitivity silver iodobromide emulsion which has been color sensitized to blue-sensitive, 1.5 g of gelatin and 0.65 g of TCP having 1.30 g of the yellow coupler (Y-1) dissolved therein.

Pr . . . A protective layer consisting mainly of gelatin.

TABLE 5

| Layer constitution I | Layer constitution II | Layer constitution III |
|---|---|---|
| Pr | Pr | Pr |
| BH | BH | BH |
| BL | I | BL |
| Y | GH | Y |
| GH | I | GH |
| GL | RH | I |
| I | I | RH |
| RH | BL | I |
| RL | I | GL |

TABLE 5-continued

| Layer constitution I | Layer constitution II | Layer constitution III |
|---|---|---|
| Base | GL | I |
| | I | RL |
| | RL | Base |
| | Base | |

The contents of the respective samples were made as shown in Table-6.

TABLE 6

| Sample No. | Layer constitution | BH layer emulsion used | GH layer emulsion used |
|---|---|---|---|
| 4 | I | EM 3 | EM 3 |
| 5 | I | EM 3 | EM 2 |
| 6 | I | EM 3 | EM 1 |
| 7 | II | EM 3 | EM 3 |
| 8 | II | EM 3 | EM 2 |
| 9 | II | EM 3 | EM 1 |
| 10 | II | EM 2 | EM 3 |
| 11 | II | EM 1 | EM 3 |
| 12 | III | EM 3 | EM 3 |
| 13 | III | EM 3 | EM 2 |
| 14 | III | EM 3 | EM 1 |

Samples No. 6, 9, 11, 14 are samples according to the present invention, and others are comparative samples.

Each sample was given wedge exposure by use of white light, and the developing processing shown below was performed.

| Processing steps (processing temperature 38° C.) | |
|---|---|
| Color developing | 3 min. 15 sec. |
| Bleaching | 6 min. 30 sec. |
| Water washing | 3 min. 15 sec. |
| Fixing | 6 min. 30 sec. |
| Water washing | 3 min. 15 sec. |
| Stabilizing | 1 min. 30 sec. |
| Drying | |

The processing liquor compositions employed in the respective processing steps are shown below.

| | |
|---|---|
| [Color developing solution] | |
| 4-Amine-3-methyl-N—ethyl-N—(β-hydroxyethyl)-aniline sulfate | 4.75 g |
| Anhydrous sodium sulfite | 4.25 g |
| Hydroxylamine ½ sulfate | 2.0 g |
| Anhydrous potassium carbonate | 37.5 g |
| Sodium bromide | 1.3 g |
| Nitrilotriacetic acid trisodium salt (monohydrate) | 2.5 g |
| Potassium hydroxide | 1.0 g |
| (made up to 1 liter with addition of water) | |
| [Bleaching solution] | |
| Ethylenediaminetetraacetic acid ammonium salt | 100.0 g |
| Ethylenediaminetetraacetic acid diammonium salt | 10.0 g |
| Ammonium bromide | 150.0 g |
| Glacial acetic acid | 10.0 ml |
| (made up to 1 liter with addition of water, and adjusted to pH 6.0 with ammonium water) | |
| [Fixing solution] | |
| Ammonium thiosulfate | 175.0 g |
| Anhydrous sodium sulfite | 8.6 g |
| Sodium metasulfite | 2.3 g |
| (made up to 1 liter with addition of water, and adjusted to pH 6.0 with acetic acid) | |
| [Stabilizing solution] | |
| Formalin (37% aqueous solution) | 1.5 ml |
| Konidax (produced by Konishiroku Photo Industry K.K.) | 7.5 ml |
| (made up to 1 liter with addition of water) | |

The developed sample was subjected to measurement of optical density by use of blue light (B) or green light (G), and sensitivity and fog were evaluated similarly as in the case of the single layer coated sample. The results are shown in Table-7 to Table-10.

TABLE 7

| Sample No. | Measurement light | Fog | Sensitivity | Remark |
|---|---|---|---|---|
| 4 | G | 0.22 | 100 | Control |
| 5 | G | 0.20 | 113 | Control |
| 6 | G | 0.18 | 125 | Invention |

TABLE 8

| Sample No. | Measurement light | Fog | Sensitivity | Remark |
|---|---|---|---|---|
| 7 | G | 0.23 | 100 | Control |
| 8 | G | 0.22 | 110 | Control |
| 9 | G | 0.19 | 118 | Invention |

TABLE 9

| Sample No. | Measurement light | Fog | Sensitivity | Remark |
|---|---|---|---|---|
| 7 | B | 0.18 | 100 | Control |
| 10 | B | 0.15 | 121 | Control |
| 11 | B | 0.13 | 132 | Invention |

TABLE 10

| Sample No. | Measurement light | Fog | Sensitivity | Remark |
|---|---|---|---|---|
| 12 | G | 0.21 | 100 | Control |
| 13 | G | 0.21 | 115 | Control |
| 14 | G | 0.18 | 121 | Invention |

From the above Tables, it can be clearly seen that the fog-sensitivity performance of the layer in which the emulsion EM-1 of the present invention is excellent as compared with the case when the control EM-2 or EM-3 is used in every layer constitution.

EXAMPLE 2

By use of the five kinds of solutions shown below, silver bromide emulsions EM-4 to 6 were prepared. As the seed emulsion, a silver bromide emulsion having an average grain size of 0.25 μm and a fluctuation coefficient of grain size distribution of 12% was used.

| | |
|---|---|
| (Solution A-2) | |
| Ossein gelatin | 85.4 g |
| Distilled water | 8460 ml |
| Polyisopropylene-polyethyleneoxy-disuccinic acid ester sodium salt 10% Ethanolic aqueous solution | 25 ml |
| 4-Hydroxy-6-methyl-1,3,3a,7-tetra-azaindene | amount as shown in Table-11 |
| 28% Aqueous ammonia solution | 130 ml |
| 56% Aqueous acetic acid solution | 60 ml |
| Seed emulsion | amount corresponding to 0.1379 mol |
| (Solution B-2) | |
| Ossein gelatin | 100 g |
| KBr | 1224 g |
| 4-Hydroxy-6-methyl-1,3,3a,7-tetra-azaindene | amount as shown in Table-11 |

-continued

| | |
|---|---|
| Distilled water | 4480 ml |
| (Solution E-2) | |
| $AgNO_3$ | 1515 g |
| 28% Aqueous ammonia solution | 1236 ml |
| Made up to 4246 ml with addition of distilled water. | |
| (Solution F-2) | |
| 50% KBr aqueous solution | amount necessary for pAg adjustment |
| (Solution G-2) | |
| 56% Acetic acid solution | amount necessary for pH adjustment |

At 40° C., the solutions E-2 and B-2 were added to the solution A-2 by the simultaneous mixing method by use of the mixing stirrer as shown in Japanese Unexamined Patent Publication Nos. 92523/1982 and 92524/1982. pAg, pH and the addition rates of E-2 and B-2 during simultaneous mixing were controlled as shown in Table 12 for EM-4 and 5, and as shown in Table 13 for EM-6. The pAg and pH were controlled by varying the flow rates of the solution F-2 and the solution G-2 by means of a flow rate variable roller tube pump.

The pAg of EM-4 was adjusted to 10.5 with the solution F-2 one minute after completion of the addition of the solution E-2 and, after stirring was continued for 10 minutes, the pH was adjusted to 6.0 with the solution G-2.

The pH of EM-5 was adjusted to 6.0 with the solution G-2 one minute after completion of the addition of the solution of E-2.

Also, the pAg of EM-6 was adjusted to 10.4 with the solution F-2 two minutes after completion of the addition of E-2, and further two minutes later, the pH was adjusted to 6.0 with the solution G-2.

Next, each emulsion was subjected to desalting and water washing in a conventional manner and dispersed in an aqueous solution containing 141 g of ossein gelatin, then made up to the total quantity of 3750 ml with distilled water, followed further by adjustment of pAg 8.5 and pH.5.8 at 40° C. with the use of the solution F-2 and G-2.

TABLE 11

| Emulsion | (Solution A-2) amount added | (Solution B-2) amount added |
|---|---|---|
| EM 4 | 125 mg | 1658 mg |
| EM 5 | 125 mg | 1658 mg |
| EM 6 | 0 | 0 |

TABLE 12

| Time (min.) | Addition rate of solution (ml/min.) E-2 | B-2 | pAg | pH |
|---|---|---|---|---|
| 0.00 | 8.09 | 8.01 | 8.60 | 9.00 |
| 7.30 | 15.02 | 14.87 | 8.60 | 8.97 |
| 11.85 | 21.80 | 21.58 | 8.60 | 8.95 |
| 17.90 | 33.91 | 33.57 | 8.60 | 8.91 |
| 24.00 | 49.28 | 48.79 | 8.60 | 8.85 |
| 30.00 | 63.51 | 62.87 | 8.60 | 8.77 |
| 34.80 | 76.07 | 75.31 | 8.60 | 8.69 |
| 39.85 | 90.26 | 89.36 | 8.60 | 8.59 |
| 45.00 | 105.70 | 104.64 | 8.60 | 8.47 |
| 50.15 | 122.30 | 121.08 | 8.60 | 8.32 |
| 55.30 | 139.90 | 138.50 | 8.60 | 8.16 |
| 60.00 | 148.80 | 147.31 | 8.60 | 8.00 |

TABLE 13

| Time (min.) | Addition rate of solution (ml/min.) E-2 | B-2 | pAg | pH |
|---|---|---|---|---|
| 0.00 | 6.53 | 6.46 | 9.20 | 9.00 |
| 9.00 | 9.60 | 9.50 | 9.20 | 8.97 |
| 16.70 | 21.09 | 20.88 | 9.20 | 8.94 |
| 23.00 | 32.67 | 32.34 | 9.20 | 8.90 |
| 29.20 | 49.94 | 49.44 | 9.20 | 8.84 |
| 33.60 | 65.90 | 65.24 | 9.20 | 8.78 |
| 37.70 | 76.50 | 75.74 | 9.30 | 8.71 |
| 42.90 | 84.83 | 83.98 | 9.43 | 8.61 |
| 47.25 | 86.83 | 85.96 | 9.55 | 8.52 |
| 53.65 | 84.08 | 83.24 | 9.73 | 8.39 |
| 58.35 | 77.48 | 76.71 | 9.85 | 8.29 |
| 64.85 | 65.18 | 64.53 | 10.00 | 8.18 |
| 72.10 | 62.32 | 61.70 | 10.00 | 8.07 |
| 77.30 | 59.88 | 59.28 | 10.00 | 8.00 |

As the result of observation by an electron microscope, EM-4 was confirmed to be a mono-dispersed emulsion comprising grains of the present invention having 8 concavities on the surface and having an average grain size of 1.0 μm and a fluctuation coefficient of grain size distribution of 12%. On the other hand, the control emulsion EM-5 was found to comprise 24-hedral grains having (nnl) face, while EM-6 comprise octahedral grains, each having an average grain size of 1.0 μm and a fluctuation coefficient of 11%.

By use of EM-4 to 6, single layer coated samples No. 15 to 17 were prepared according to the same method as in Example 1 and performances were compared to give the results as shown in Table-14.

TABLE 14

| Sample | Emulsion used | Fog | Relative sensitivity |
|---|---|---|---|
| No. 15 (Invention) | EM 4 | 0.08 | 131 |
| No. 16 (Control) | EM 5 | 0.08 | 122 |
| No. 17 (Control) | EM 6 | 0.09 | 100 |

As can be seen from Table-14 , the sample No. 15 by use of the grains according to the present invention is clearly superior in fog-sensitivity characteristic to control samples No. 16 and No. 17.

EXAMPLE 3

By use of the seven kinds of solutions shown below, core/shell type silver iodobromide emulsions EM-7 to 9 in which the silver iodide content is varied from the grain surface to the inner portion as 0.3 mol %, 5 mol % and 15% were prepared. As the seed emulsion, a mono-dispersed silver iodobromide emulsion containing 6 mol % of silver iodobromide and having an average grain size of 0.8 μm and a fluctuation coefficient of grain size distribution of 10% was employed.

| | |
|---|---|
| (Solution A-3) | |
| Ossein gelatin | 22.5 g |
| Distilled water | 6850 ml |
| Polyisopropylene-polyethyleneoxy-disuccinic acid ester sodium salt 10% Ethanolic aqueous solution | 20 ml |
| 4-Hydroxy-6-methyl-1,3,3a,7-tetra-azaindene | amount as shown in Table-15 |
| 28% Aqueous ammonia solution | 469 ml |
| 56% Aqueous acetic acid solution | 258 ml |
| Seed emulsion | amount corresponding to 0.8828 mol |

-continued

| | |
|---|---|
| (Solution B-3) | |
| Ossein gelatin | 24 g |
| KBr | 848 g |
| KI | 209 g |
| 4-Hydroxy-6-methyl-1,3,3a,7-tetra-azaindene | amount as shown in Table-15 |
| Distilled water | 1978 ml |
| (Solution C-3) | |
| Ossein gelatin | 24 g |
| KBr | 948 g |
| KI | 69.7 g |
| 4-Hydroxy-6-methyl-1,3,3a,7-tetra-azaindene | amount as shown in Table-15 |
| Distilled water | 1978 ml |
| (Solution D-3) | |
| Ossein gelatin | 40 g |
| KBr | 1660 g |
| KI | 6.97 g |
| 4-Hydroxy-6-methyl-1,3,3a,7-tetra-azaindene | amount as shown in Table-15 |
| Distilled water | 3296 ml |
| (Solution E-3) | |
| $AgNO_3$ | 1109 g |
| 28% Aqueous ammonia | 904 ml |
| Made up to 1866 ml with addition of distilled water. | |
| (Solution F-3) | |
| 50% KBr aqueous solution | amount necessary for pAg adjustment |
| (Solution G-3) | |
| 56% Acetic acid solution | amount necessary for pH adjustment |

At 50° C., the solutions E-3 and B-3 were added to the solution A-3 by the simultaneous mixing method by use of a mixing stirrer shown in Japanese Unexamined patent publications Nos. 92523/1982 and 92524/1982, and C-3 added simultaneously with completion of the addition of B-3 and D-3 added simultaneously with completion of the addition of C-3. The pAg and pH and the addition rates of E-3 , B-3, C-3 and D-3 during simultaneous mixing were controlled as shown in Table 16 for EM-7 and 8, and as shown in Table 17 for EM-9. The pAg and pH were controlled by varying the flow rates of the solution F-3 and a solution G-3 by means of a flow rate variable roller tube pump.

The pAg of EM-7 was adjusted to 10.5 with the solution F-3 one minute after completion of the addition of the solution E-3 and, after stirring was continued for 10 minutes, the pH was adjusted to 6.0 with the solution G-3.

The pH of EM-8 was adjusted to 6.0 with the solution G-3 one minute after completion of the addition of the solution E-3.

Also, the pAg of EM-9 was adjusted to 10.4 with the solution F-3 two minutes after completion of the addition of the solution E-3, and further two minutes later the pH was adjusted to 6.0 with the solution G-3.

Next, each emulsion was subjected to desalting and water washing in a conventional manner, dispersed in an aqueous solution containing 127 g of ossein gelatin and then made up to a total amount of 3000 ml with distilled water, followed further by adjustment of pAg 8.5 and pH 5.8 at 40° C. with the use of the solutions F-3 and G-3.

TABLE 15

| Emulsion | (Solution A-3) amount added | (Solution B-3) amount added | (Solution C-3) amount added | (Solution D-3) amount added |
|---|---|---|---|---|
| EM 7 | 625 mg | 375 mg | 375 mg | 625 mg |
| EM 8 | 625 mg | 375 mg | 375 mg | 625 mg |
| EM 9 | 646 mg | 2560 mg | 2560 mg | 4268 mg |

TABLE 16

| Time (min) | Addition rate of solution (ml/min.) E-3 | B-3 | C-3 | D-3 | pAg | pH |
|---|---|---|---|---|---|---|
| 0.00 | 6.44 | 6.38 | 0 | 0 | 8.60 | 9.00 |
| 16.95 | 7.90 | 7.82 | 0 | 0 | " | 9.00 |
| 31.24 | 9.06 | 8.97 | 0 | 0 | " | 9.00 |
| 51.40 | 10.57 | 10.46 | 10.46 | 0 | " | 9.00 |
| 58.30 | 14.00 | 0 | 13.86 | 0 | " | 9.00 |
| 62.05 | 17.70 | 0 | 17.53 | 0 | " | 9.00 |
| 64.95 | 23.31 | 0 | 23.08 | 0 | " | 9.00 |
| 66.40 | 28.99 | 0 | 28.70 | 0 | " | 9.00 |
| 67.65 | 33.26 | 0 | 32.92 | 0 | " | 8.97 |
| 73.90 | 37.89 | 0 | 37.51 | 0 | " | 8.65 |
| 77.00 | 40.29 | 0 | 39.89 | 0 | " | 8.48 |
| 80.50 | 43.15 | 0 | 42.72 | 42.72 | " | 8.26 |
| 81.30 | 43.74 | 0 | 0 | 43.30 | " | 8.22 |
| 85.10 | 41.38 | 0 | 0 | 40.96 | " | 8.00 |
| 87.60 | 39.30 | 0 | 0 | 38.91 | " | 7.85 |
| 93.58 | 28.68 | 0 | 0 | 28.39 | " | 7.57 |
| 95.55 | 26.40 | 0 | 0 | 26.14 | " | 7.50 |

TABLE 17

| Time (min) | Addition rate of solution (ml/min.) E-3 | B-3 | C-3 | D-3 | pAg | pH |
|---|---|---|---|---|---|---|
| 0.00 | 7.07 | 7.00 | — | — | 8.70 | 9.00 |
| 18.00 | 8.89 | 8.80 | — | — | 8.70 | 9.00 |
| 27.00 | 9.75 | 9.65 | — | — | 8.70 | 9.00 |
| 36.00 | 10.55 | 10.45 | — | — | 8.70 | 9.00 |
| 45.00 | 11.29 | 11.18 | — | — | 8.70 | 9.00 |
| 46.60 | 11.51 | 11.40 | 11.40 | — | 8.70 | 9.00 |
| 54.80 | 16.44 | — | 18.12 | — | 8.93 | 8.86 |
| 63.05 | 21.38 | — | 24.73 | — | 9.30 | 8.66 |
| 72.05 | 32.84 | — | 60.87 | — | 9.96 | 8.31 |
| 75.50 | 26.31 | — | 54.69 | — | 10.19 | 8.21 |
| 82.50 | 24.12 | — | 23.88 | 23.88 | 10.20 | 8.04 |
| 90.06 | 21.89 | — | — | 21.67 | 10.20 | 7.86 |
| 99.08 | 20.13 | — | — | 19.93 | 10.20 | 7.66 |
| 108.00 | 19.25 | — | — | 19.06 | 10.20 | 7.50 |

As the result of observation by an electron microscope, EM-7 according to the present invention was confirmed to be a mono-dispersed emulsion comprising grains having 12 concavities on the surface and having an average grain size of 1.60 μm and a fluctuation coefficient of grain size distribution of 13% . On the other hand, the control emulsion EM-8 was found to be a mono-dispersed emulsion comprising 24-hedral grains having (nnl) face and having an average grain size of 1.6 μm and a fluctuation coefficient of grain size distribution of 12% , while EM-9 an emulsion comprising octahedral grains having a mean grain size of 1.60 μm and a fluctuation coefficient of 11%.

By use of the above EM-7 to 9, multi-layer color light-sensitive materials No. 18 to No. 23 with the contents as shown in Table-18 were prepared similarly as in Example 1 and their performances were compared. The characteristics of the respective samples were found to be as shown in Tables 19 to 20.

TABLE-18

| Sample No. | Layer structure | BH layer emulsion used | GH layer emulsion used |
|---|---|---|---|
| 18 | I | EM 3 | EM 9 |
| 19 | I | EM 3 | EM 8 |
| 20 | I | EM 3 | EM 7 |
| 21 | I | EM 9 | EM 3 |
| 22 | I | EM 8 | EM 3 |
| 23 | I | EM 7 | EM 3 |

TABLE-19

| Sample No. | Measurement light | Fog | Sensitivity | Remark |
|---|---|---|---|---|
| 18 | G | 0.24 | 100 | Control |
| 19 | G | 0.24 | 108 | Control |
| 20 | G | 0.23 | 125 | Invention |

TABLE-20

| Sample No. | Measurement light | Fog | Sensitivity | Remark |
|---|---|---|---|---|
| 21 | B | 0.19 | 100 | Control |
| 22 | B | 0.17 | 109 | Control |
| 23 | B | 0.17 | 129 | Invention |

p As can be seen from the Tables, the samples No. 20 and No. 23 containing the grains of the present invention exhibit excellent performances in both fog and sensitivity.

EXAMPLE 4

Preparation of a silver chlorobromide emulsion containing 50 mol % of silver bromide and having an average grain size of 1.0 μm.

According to the recipes shown below, the emulsion EM-10 and the control emulsions EM-11 and 12 each containing 50 mol % of silver bromide and having an average grain size of 1.0 μm were prepared.

| | |
|---|---|
| (Solution A-4) | |
| Ossein gelatin | 57.5 g |
| Distilled water | 6900 ml |
| Polyisopropylene-polyethyleneoxy-disuccinic acid ester sodium salt 10% Ethanolic aqueous solution | 6.5 ml |
| 4-Hydroxy-6-methyl-1,3,3a,7-tetra-azaindene | amount as shown in Table-21 |
| 56% Aqueous acetic acid solution | 28 ml |
| $NH_4OH$ | 1.76 mol |
| Seed emulsion (a monodispersed silver chlorobromide emulsion having an average grain size of 0.33 μm and containing 50 mol % of silver bromide) | amount corresponding to 0.254 mol |
| (Solution B-4) | |
| Ossein gelatin | 48 g |
| KBr | 428.4 g |
| NaCl | 210.4 g |
| Polyisopropylene-polyethyleneoxy-disuccinic acid ester sodium salt 10% Ethanolic aqueous solution | 4.8 ml |
| 4-Hydroxy-6-methyl-1,3,3a,7-tetra-azaindene | amount as shown in Table-21 |
| Made up to 2400 ml with addition of distilled water. | |
| (Solution E-4) | |
| $AgNO_3$ | 1223 g |
| Distilled water | 672 ml |
| $NH_4OH$ | 15.12 mol |
| Made up to 2400 ml with addition of distilled water. | |
| (Solution F-4) | |
| KBr | 0.948 g |
| NaCl | 116.2 g |
| Made up to 2000 ml with addition of distilled water. | |
| (Solution G-4) | |
| 65% Acetic acid solution | 2000 ml |

TABLE-21

| Emulsion No. | 4-Hydroxy-6-methyl-1,3,3a,7-tetraazaindene amount added (mg) Solution A-4 | Solution B-4 |
|---|---|---|
| EM-10 | 128 | 549 |
| EM-11 | 128 | 549 |
| EM-12 | 0 | 0 |

For each emulsion, at 40° C., the solutions A-4, B-4 and E-4 were added according to the double jet method under stirring by use of a mixing stirrer as shown in Japanese unexamined patent publications Nos. 58288/1983 and 58289/1983. The addition rate was increased in shape of a flexed line with addition time as shown in Table 22. Also, during addition of each solution, the pAg of the mixture was controlled to 8.0 (EAg value+100 mV) with the solution F-4, and the pH of the mixture was controlled so as to be lowered with time as shown in Table 22 with the solution G-4. The solutions B-4, E-4, G-4 and F-4 were added by use of a flow rate variable type roller tube quantitative metering pump.

The pAg of EM-10 was adjusted to 8.8 with the solution F-4 two minutes after completion of addition of the solutions B-4 and E-4 and, after stirring was continued for 1 hour, the pH was adjusted to 6.0 with the solution G-4.

The pH of EM-11 and 12 was adjusted to 6.0 with the solution G-4 two minutes after completion of the addition of the solutions B-4 and E-4. Subsequently, water washing and desalting of the emulsions were performed according to the following operations. The emulsion was agglomerated with addition of 913 ml of an aqueous 5% solutions of Demol N (produced by Kao Atlas Co.) and 691 ml of an aqueous 20% magnesium sulfate solution as the precipitating agent. After precipitation by stationary standing, the supernatent was decanted and the precipitate was again dispersed with addition of 15375 ml of distilled water. After agglomeration and precipitation of the emulsion again by addition of 541 ml of an aqueous 20% magnesium sulfate solution, the supernatent was decanted and 1000 ml of an aqueous ossein gelatin solution (containing 80 g of ossein gelatin) was added. After dispersed by stirring at 40° C. for 20 minutes, the total amount was made up to 5000 ml with distilled water. Further, the pAg at 40° C. was adjusted to 7.5 with the solution F-4.

As the result of observation by a nelectron microscope, EM-10 was confirmed to be a mono-dispersed emulsion containing the rains according to the present invention having 12 concavities on the surface and having an average grain size of 1.03 μm and a fluctuation coefficient of grain size distribution of 9.9% . On the other hand, the control emulsion EM-11 was found to be a mono-dispersed emulsion comprising 24-hedral grains having (nnl) face and having a mean grain size of 1.03 μm and a fluctuation coefficeint of grain size distribution of 9.7%, while EM-12 an emulsion comprising cubic grains having an average grain size of 1.01 μm and a fluctuation coefficient of 8.7%.

TABLE 22

| Addition time (min) | Addition rate of solution E-4 (ml/min) | pH |
|---|---|---|
| 0.0 | 7.6 | 9.00 |
| 2.9 | 8.8 | 8.98 |
| 5.4 | 10.0 | 8.97 |
| 7.6 | 11.0 | 8.96 |
| 11.6 | 13.0 | 8.93 |
| 16.5 | 15.6 | 8.90 |
| 22.0 | 18.8 | 8.85 |
| 26.7 | 21.7 | 8.80 |
| 33.5 | 26.3 | 8.71 |
| 39.4 | 30.5 | 8.62 |
| 45.8 | 35.4 | 8.51 |
| 51.4 | 40.0 | 8.40 |
| 60.0 | 47.6 | 8.26 |
| 67.4 | 54.6 | 8.13 |
| 74.3 | 61.5 | 8.00 |

[Preparation of light-sensitive material]

Each 0.353 mol of EM-10 to EM-12 was optimally applied with chemical sensitization by addition of sodium thiosulfate. Next, separately, 103 g of a yellow coupler (the compound shown below) was dissolved by heating at 60° C. in a mixture of 62 g of dioctyl phthalate and 150 ml of ethyl acetate, and the resultant solution was added to 1000 ml of an aqueous solution of 40° C. containing 60g gelatin and 5.1 g of sodium dodecyl benzene sulfcnate. After dispersed by vigorous stirring by a homogenizer, the whole mixture was made up to 1500 ml with water to prepare an emulsion of the coupler.

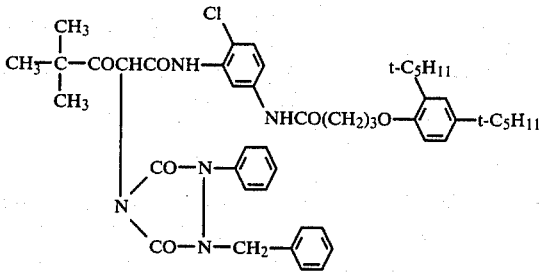

Each 0.118 mol of the emulsions applied with the above chemical sensitization was mixed with 500 ml with the above emulsion of the coupler and 20 ml of a 3% methanolic solution of 1,3,5-triacryloyl-hexahydrotriadine as the film hardener was added before coating on a polyethylene resin coated paper (samples No. 24–No. 26).

After each of the above samples was exposed to blue light through an optical wedge, the following processing was conducted, followed by measurement.

| [Processing steps] | [Temperature] | [Time] |
|---|---|---|
| Color developing | 30° C. | 6 min |
| Stopping | 30° C. | 1 min |
| Fixing | 30° C. | 2 min |
| Water washing | 30° C. | 2 min |
| Bleach-fixing | 30° C. | 2 min |
| Water washing | 30° C. | 2 min |

(Composition of color developing solution)

| | |
|---|---|
| Anhydrous sodium carbonate | 2.6 g |
| Anhydrous sodium bicarbonate | 3.5 g |
| Potassium sulfite | 18 g |
| Sodium chloride | 0.2 g |
| Potassium bromide | 1.3 g |
| Potassium hydroxide | 0.4 g |

-continued

| | |
|---|---|
| Hydroxyaminesulfate | 2 g |
| 4-Amino-methyl-N—ethyl-N—(β-methanesulfone-amidoethyl)-aniline | 5 g |
| (made up to 1 liter with addition of water; pH 10.2) | |
| (Stopping solution) | |
| 2% Aqueous acetic solution | |
| (Fixing solution) | |
| Ammonium thiosulfate | 175.0 g |
| Anhydrous sodium sulfite | 8.6 g |
| Sodium metasulfite | 2.3 g |
| (made up to 1 liter with addition of water, and adjusted to pH 6.0 with acetic acid) | |
| (Bleach-fixing solution) | |
| Ammonium thiosulfate | 100 g |
| Potassium sulfite | 5 g |
| Na[Fe(EDTA)] | 40 g |
| EDTA | 4 g |
| (made up to 1 liter with addition of water) | |

The respective samples obtained were found to exhibit sensitivities and fog as shown in Table 23.

TABLE-23

| Sample | Emulsion used | Fog | Relative sensitivity |
|---|---|---|---|
| No. 24 (Invention) | EM-10 | 0.04 | 142 |
| No. 25 (Control) | EM-11 | 0.04 | 131 |
| No. 26 (Control) | EM-12 | 0.05 | 100 |

As can be seen from the Table, the Sample No. 24 by use of the silver halide grains according to the present invention is more excellent in sensitivity-fog characteristic than control samples No. 25 and 26.

EXAMPLE 5

Preparation of silver chlorobromide emulsion containing 15 mol % of silver bromide and having an average grain size of 1.0 μm.

According to the recipes shown below, the emulsion according to the present invention (EM 13) and control emulsion (EM-14, 15) each containing 15 mol % of silver bromide and having an average grain size of 1.0 μm were prepared.

| | |
|---|---|
| (Solution A-5) | |
| Ossein gelatin | 57.5 g |
| Distilled water | 6900 ml |
| Polyisopropylene-polyethyleneoxy-disuccinic acid ester sodium salt 10% Ethanolic aqueous solution | 6.5 ml |
| 4-Hydroxy-6-methyl-1,3,3a,7-tetra-azaindene | amount as shown in Table-24 |
| 56% Aqueous acetic acid solution | 28 ml |
| $NH_4OH$ | 1.76 mol |
| Seed emulsion (a monodispersed silver chlorobromide emulsion having an average grain size of 0.40 μm and containing 15 mol % of silver bromide) | amount corresponding to 0.452 mol |
| (Solution B-5) | |
| Ossein gelatin | 48 g |
| KBr | 128.5 g |
| NaCl | 357.7 g |
| Polyisopropylene-polyethyleneoxy-disuccinic acid ester sodium salt 10% Ethanolic aqueous solution | 4.8 ml |
| 4-Hydroxy-6-methyl-1,3,3a,7-tetra-azaindene | amount as shown in Table-24 |
| Made up to 2400 ml with addition of distilled water. | |
| (Solution E-5) | |
| $AgNO_3$ | 1223 g |
| Distilled water | 672 ml |
| $NH_4OH$ | 15.12 mol |

-continued

| | |
|---|---|
| Made up to 2400 ml with addition of distilled water. | |
| (Solution F-5) | |
| KBr | 0.168 g |
| NaCl | 116.8 g |
| Made up to 2000 ml with addition of distilled water. | |
| (Solution G-5) | |
| 65% Acetic acid solution | 2000 ml |

TABLE-24

| Emulsion No. | 4-Hydroxy-6-methyl-1,3,3a,7-tetraazaindene amount added (mg) Solution A-5 | Solution B-5 |
|---|---|---|
| EM-13 | 56 | 682 |
| EM-14 | 56 | 682 |
| EM-15 | 0 | 0 |

For each emulsion, at 40° C., the solutions B-5 and E-5 were added to the solution A-5 according to the double jet method under stirring by use of a mixing stirrer as shown in Japanese Patent Publications Nos. 58288/1983 and 58289/1983. The addition rate was increased in shape of a flexed line with addition time as shown in Table 25. Also, during addition of each solution, the pAg of the mixture was controlled to 8.8 (EAg value+52 mV) with the solution F-5, and also the pH of the mixture was controlled so as to be lowered with time with a solution G-5. The solutions B-5, E-5, F-5 and G-5 were added by use of flow rate variable type roller tube quantitative metering pump.

The pAg of EM-13 was adjusted to 8.9 with the solution F-5 two minutes after completion of the addition of the solutions B-5 and E-5 and, after stirring was continued for one hour, the pH was adjusted to 6.0 with the solution G-5.

The pH of EM-14 and 15 was adjusted to 6.0 with the solution G-5 two minutes after completion addition of the solutions B-5 and E-5. Next, water washing and desalting of the emulsion was conducted according to the following operations. The emulsion was agglomerated with addition of 913 ml of an aqueous 5% solution of Demol N (produced by Kao Atlas Co.) and 691 ml of an aqueous 20% magnesium sulfate as the precipitating agents. After precipitation by stationary standing, the supernatent was decanted and the precipitate was again dispersed by addition of 15375 ml of distilled water. After agglomerating and precipitating again the emulsion with addition of 541 ml of an aqueous 20% magnesium sulfate solution, the supernatent was decanted and 1000 ml of an aqueous solution of ossein glatin (containing 80 g of ossein gelatin) was added. After dispersed with stirring at 40° C. for 20 minutes, the total amount was made up to 5000 ml with distilled water.

Further, the pAg at 40° C. was adjusted to 7.5 with the solution F-5.

As the result of observation by an electromicroscope, EM-13 was confirmed to contain the grains according to the present invention having 8 or 12 concavities on the surface and having an average grain size of 1.01 μm and a fluctuation coefficient of grain size distribution of 9.8% . On the other hand, the control emulsion EM-14 was found to be a mono-dispersed emulsion comprising 24-hedral grains having (nnl) face and having a naverage grain size of 1.01 μm and a fluctuation coefficient of grain size distribution of 9.6%, while EM-15 an emulsion comprising cubic grains having an average grain size of 1.03 μm and a fluctuation coefficient of 9.1%.

TABLE-25

| Addition time (min) | Addition rate of solution 5-C (ml/min) | pH |
|---|---|---|
| 0.0 | 9.3 | 9.00 |
| 2.3 | 10.8 | 8.98 |
| 4.4 | 12.3 | 8.97 |
| 7.8 | 15.4 | 8.94 |
| 11.8 | 20.1 | 8.91 |
| 15.9 | 26.4 | 8.85 |
| 20.5 | 34.6 | 8.78 |
| 25.3 | 43.4 | 8.67 |
| 30.2 | 52.6 | 8.55 |
| 35.2 | 61.0 | 8.39 |
| 40.2 | 70.0 | 8.27 |
| 45.0 | 76.9 | 8.15 |
| 50.4 | 80.3 | 8.00 |

By use of the above EM-13 to 15, light-sensitive materials No. 27 to 29 were prepared and the performances were compared.

The characteristics of the respective materials were found to be as shown in Table-26.

TABLE-26

| Sample | Emulsion used | Fog | Relative sensitivity |
|---|---|---|---|
| No. 27 | EM-13 | 0.04 | 139 |
| No. 28 | EM-14 | 0.05 | 135 |
| No. 29 | EM-15 | 0.09 | 100 |

As is apparent from the Table, the sample No. 27 by use of the silver halide grains according to the present invention is more excellent in sensitivity-fog characteristic than the control samples No. 28 and 29.

EXAMPLE 6

The 24-hedral mono-dispersed silver iodobromide emulsion EM-2 prepared in Example 1 was adjusted to pAg 9.5 at 50° C. with addition of an aqueous KBr solution and, after stirring for 10 minutes, the temperature was lowered to 40° C. and pAg was adjusted to 8.5 by addition of an aqueous $AgNO_3$ solution (the treatment method according to the present invention) to prepare EM-16.

Similarly, EM-2 was adjusted to pAg 10.2 at 60° C. with addition of an aqueous KBr solution and after stirring for 3 hours, the temperature was lowered to 40° C. and an aqueous $AgNO_3$ solution was added to adjust pAg to 8.5 to prepare EM-17.

As the result of observation by an electron microscope, EM-17 was found to contain grains having 12 concavities on the surface, thus exhibiting clear difference from EM-2, but there was no distinct this difference between EM-2 and EM-16. When single layer coated samples were prepared according to the same method as in Example 1, and fog and sensitivity were measured, both EM-16 and 17 had higher sensitivities than EM-2 as shown in Table 27. From this result, it can be seen that the treatment method of the present invention is useful for supplying high sensitivity emulsion, particularly effective when concavities are generated.

TABLE 27

| Sample | Emulsion used | Fog | Relative sensitivity | Remark |
|---|---|---|---|---|
| No. 2 | EM2 | 0.11 | 100 | Control |
| No. 30 | EM16 | 0.11 | 109 | Invention |

TABLE 27-continued

| Sample | Emulsion used | Fog | Relative sensitivity | Remark |
|---|---|---|---|---|
| No. 31 | EM17 | 0.13 | 115 | Invention |

We claim:

1. A silver halide grain which has 8 to 12 concavities on the surface.

2. The silver halide grain according to claim 1, wherein the silver halide constituting the said grain comprises silver chloride, silver bromide, silver chlorobromide, silver iodobromide or silver chloroiodobromide.

3. The silver halide grain according to claim 2, wherein said silver iodobromide or said chloroiodobromide contains silver iodide in an amount of 40 mol % or less.

4. The silver halide grain according to claim 1, wherein said grain is prepared by treating a silver halide grain comprising a normal crystal of the silver halide, under pAg which is higher than the average pAg of the mother liquor during formation of said grain.

5. The silver halide grain according to claim 4, wherein said grain is prepared by treating a silver halide grain having the (110) face and/or the (nnl) face, under pAg which is higher than the average pAg of the mother liquor during formation of said grain.

6. The silver halide grain according to claim 5, wherein said treating of said grain is performed under pAg of 9.0 or more in case of silver halide constituting said grain is silver bromide, silver iodobromide or silver chloroiodobromide and under pAg of 7.0 or more in case of silver halide constituting said grain is silver chlorobromide.

7. The silver halide grain according to claim 1, wherein said grain is mono-dispersed.

8. The silver halide grain according to claim 1, wherein said grain has an average diameter of 0.1 to 0.3 μm.

9. The silver halide grain according to claim 1, wherein said treating of said grain is performed at a period before initiation of chemical aging.

10. A photographical light-sensitive material containing a silver halide grain comprising 8 to 12 concavities on the surface.

11. The photographical light-sensitive material according to claim 10, wherein said grain is applied to the layer with higher sensitivity when said material has at least two kinds of emulsion layers with different sensitivities.

12. The silver halide grain of claim 2 having 8 concavities on its surface.

13. The silver halide grain of claim 2 having 12 concavities on its surface.

14. The silver halide grain of claim 3 having 8 concavities on its surface.

15. The silver halide of claim 3 having 12 concavities on its surface.

16. The silver halide grain of claim 6 having 8 concavities on its surface.

17. The silver halide of claim 6 having 12 concavities on its surface.

18. The silver halide grain of claim 8 having 8 concavities on its surface.

19. The silver halide of claim 8 having 12 concavities on its surface.

* * * * *